US009161594B2

(12) United States Patent
Jungkind

(10) Patent No.: US 9,161,594 B2
(45) Date of Patent: Oct. 20, 2015

(54) CLEAT FOR A SPORTS SHOE

(75) Inventor: Roland Jungkind, Garmisch-Partenkirechen (DE)

(73) Assignee: Framas Kunststofftechnik GmbH, Pirmasens (DE)

( * ) Notice: Subject to any disclaimer, the term of this patent is extended or adjusted under 35 U.S.C. 154(b) by 241 days.

(21) Appl. No.: 13/383,070

(22) PCT Filed: Aug. 26, 2010

(86) PCT No.: PCT/EP2010/062513
§ 371 (c)(1),
(2), (4) Date: Mar. 23, 2012

(87) PCT Pub. No.: WO2011/023780
PCT Pub. Date: Mar. 3, 2011

(65) Prior Publication Data

US 2012/0174441 A1 Jul. 12, 2012

(30) Foreign Application Priority Data

Aug. 26, 2009 (DE) ..... 10 2009 038 885

(51) Int. Cl.

| | |
|---|---|
| ***A43C 15/00*** | (2006.01) |
| ***A43B 13/22*** | (2006.01) |
| ***A43B 5/00*** | (2006.01) |
| ***A43C 15/16*** | (2006.01) |
| ***A43B 5/02*** | (2006.01) |

(52) U.S. Cl.
CPC ..... *A43C 15/161* (2013.01); *A43B 5/001* (2013.01); *A43B 5/02* (2013.01); *A43C 15/005* (2013.01)

(58) Field of Classification Search
CPC ..... A43C 15/161; A43C 5/00; A43C 15/165; A43C 15/005; A43B 13/36; A43B 5/001; A43B 5/02; A43D 100/14
USPC ..... 36/37, 67 A, 67 B, 67 C, 67 D, 15, 134, 36/127, 34 R–42
See application file for complete search history.

(56) References Cited

U.S. PATENT DOCUMENTS 2,682,714 A * 7/1954 Phillips ..... 36/59 R
4,035,934 A * 7/1977 Hrivnak ..... 36/67 D
(Continued)

FOREIGN PATENT DOCUMENTS

DE 31 34 817 A1 3/1983
DE 20211809 U1 12/2003
(Continued)

*Primary Examiner* — Jila M Mohandesi
*Assistant Examiner* — Katharine Gracz
(74) *Attorney, Agent, or Firm* — Glenn M. Massina, Esq.; Fox Rothschild LLP

(57) ABSTRACT

A cleat for a sports shoe including a cleat base having an opening and a cleat tip having a connecting element. The connecting element has the shape of a pin which exhibits a first diameter and a second diameter, measured perpendicular to the first diameter, which is smaller than the first diameter. In order to connect the cleat tip to the cleat base, the connecting element can be pressed into the opening and the cleat tip is held in the cleat base by a force fit.

14 Claims, 4 Drawing Sheets

(56) References Cited

U.S. PATENT DOCUMENTS

| | | | | |
|---|---|---|---|---|
| 5,036,606 | A * | 8/1991 | Erich et al. | 36/134 |
| 6,079,127 | A * | 6/2000 | Nishimura et al. | 36/61 |
| 6,510,625 | B2 * | 1/2003 | Sato et al. | 36/36 R |
| 6,513,266 | B1 * | 2/2003 | Ijiri | 36/134 |
| 6,601,322 | B2 * | 8/2003 | Hsiao | 36/134 |
| 2003/0106245 | A1 | 6/2003 | Hsiao | |
| 2004/0107606 | A1 * | 6/2004 | De Paoli | 36/134 |
| 2004/0159021 | A1 * | 8/2004 | Auger et al. | 36/134 |
| 2006/0179688 | A1 * | 8/2006 | Briant et al. | 36/134 |
| 2006/0277800 | A1 * | 12/2006 | Santos et al. | 36/134 |

FOREIGN PATENT DOCUMENTS

| | | | |
|---|---|---|---|
| EP | 1728448 | A1 | 12/2006 |
| JP | 59145830 | U | 9/1984 |
| WO | 03/055341 | A2 | 7/2003 |

* cited by examiner

CLEAT FOR A SPORTS SHOE

CROSS REFERENCE TO RELATED APPLICATIONS

This application is the U.S. National Phase application of PCT International Application No. PCT/EP2010/062513, filed Aug. 26, 2010, which claims priority to German Patent Application No. 10 2009 038 885.0, filed Aug. 26, 2009, the contents of such applications being incorporated by reference herein.

FIELD OF THE INVENTION

The invention relates to a cleat for a sports shoe, for example a running shoe, football boot or golf shoe, which consists of a cleat tip and a cleat base, wherein the cleat tip comprises a non-circular connecting element and the cleat base comprises an opening, preferably a circular opening, into which the connecting element is pressed in order to connect the cleat tip to the cleat base. A force-fit connection between the two parts of the cleat is established solely by pressing the cleat tip into the cleat base. The invention also relates to the method for connecting the cleat tip to the cleat base.

BACKGROUND OF THE INVENTION

Fitting shoes, in particular sports shoes, with cleats in order to provide the shoe with special characteristics has been known for some time. Thus, for example, sprinters have for some time used spikes which exhibit different shapes depending on the surface on which the sprinter is running. Footballers also use cleats which can be different depending on the weather and the surface of the pitch. Since separate shoes or boots for each type of weather are not kept at hand, cleats were soon developed which can be detachably connected to the sole of a shoe or boot, such that it is possible to change the cleats as simply as possible.

A sports shoe with a cleat is known from WO 03/055341 A2, in which the cleat comprises a latching pin using which the cleat is spring-elastically latched in a cavity of the sole automatically, wherein the cleat can be attached manually and is detached by being rotated with the aid of a tool. DE 31 34 817 A1 describes a connection between the sole of a shoe and a gripping element by means of locking elements, wherein the part of the gripping element which protrudes into the sole of the shoe comprises, as a locking element, an appendage which is substantially radially aligned and, when rotated, is brought into engagement with a counterlock arranged within the sole of the shoe. In the engagement, the locking element grips behind the counterlock in such a way that the gripping element is connected, biased, to the sole of the shoe.

It is an object of at least one embodiment of the invention to provide a cleat for a sports shoe which can be cost-effectively produced and easily exchanged. Another object is to provide a corresponding method for connecting the cleat to the sole of the shoe.

SUMMARY OF THE INVENTION

The invention relates to a cleat for a sports shoe which comprises a cleat base having an opening and a cleat tip having a connecting element. In order to connect the cleat tip to the cleat base, the connecting element is pressed into the opening of the cleat base. The connecting element has the shape of a non-circular pin which exhibits a first diameter and a second diameter, measured perpendicular to the first diameter, which is smaller than the first diameter, and the cleat tip is held in the cleat base by a force fit, preferably solely by a force fit, after it has been pressed in.

The cleat consists of a cleat tip and a cleat base, wherein the "cleat base" refers to the part of the cleat which is connected to the sole of the sports shoe or arranged in the sole of the sports shoe, for example inserted into the die and injected, when the sole is produced. Theoretically, the cleat base can also be latterly introduced, for example glued or fused or otherwise fastened in a known way, in openings in the sole of the shoe.

The "cleat tip" refers to the part of the cleat which protrudes from the sole and can be pressed into and removed from the cleat base, i.e. the cleat base cannot generally be separated from the sports shoe without being destroyed, while the cleat tip can be exchanged.

In accordance with the invention, the connecting element comprises a non-circular pin. The pin can for example have an oval or elliptical circumference or any other circumferential shape which exhibits a first diameter and a second diameter which is measured perpendicular to the first diameter, wherein the second diameter is smaller than the first diameter. The pin can comprise sections which exhibit different cross-sections; preferably, the shape of the pin is the same throughout, i.e. there are no sections exhibiting different cross-sections, as viewed over the length of the pin. The pin is preferably beveled at its lower end, in order to facilitate inserting the pin into the opening of the cleat base.

The opening in the cleat base is preferably circular, wherein the diameter of the opening at least substantially corresponds to the first diameter of the connecting element.

The cleat base preferably comprises a spring which holds the connecting element in the cleat base in a force fit. The spring is preferably a leaf spring which is held in the cleat base on at least one side and extends into the opening in the cleat base. The spring preferably comprises a spring tip and a spring base, wherein the spring tip comprises an opening, preferably a substantially circular opening, which exhibits substantially the same diameter as the opening in the cleat base, wherein the spring is arranged in the cleat base such that when the connecting element is pressed into the cleat base, at least a partial section of the length of the connecting element is also pressed through the opening of the spring.

The spring comprises a break between the spring base and the spring tip, such that the spring tip protrudes from the spring base at an angle. If the spring is installed in the cleat base, the spring base lies approximately parallel to the sole of the shoe, while the spring tip is angled away from the sole of the shoe towards the cleat tip at an angle of between 5° and 30° and preferably by about 10°. In order to enable the spring to be positioned in this way, the cleat base comprises a corresponding receptacle for the spring. The receptacle is formed such that the spring cannot be shifted horizontally (parallel to the sole of the shoe) in the cleat base, but the spring tip can be moved in the vertical direction (perpendicular to the sole of the shoe).

When the connecting element is pressed into the cleat base, the break line of the spring preferably lies transverse to the first diameter which substantially corresponds to the diameter of the openings in the spring and cleat base. When the cleat tip is pressed into the cleat base, a connecting member presses the angled spring tip through the opening in the cleat base and thus towards the sole of the shoe. If the spring tip is substantially parallel to the sole of the shoe, then the projection of the hole in the spring tip exhibits a substantially circular surface, such that the connecting element can be pressed through the opening in the spring tip. Once the cleat tip has been completely pressed in, the spring tip is pressed away from the sole of the shoe again due to the spring force implied by the break, thus clamping the cleat tip in the cleat base. If pressure is then applied to the cleat tip, the connecting element can then be pressed further into the cleat base, until the lower side of the cleat tip and the upper side of the cleat base abut, without this reducing the holding force of the spring. If a tensile force is applied to the cleat tip, then the holding force of the spring increases as the tensile force increases. If the connecting member is rotated by for example 90° from the pressing-in position into a second position, then the second, smaller diameter of the connecting element is transverse to the break in the spring, and the cleat tip can be removed from the cleat base without any major exertion of force.

In order to rotate the connecting element, its upper side comprises for example an engagement for a tool. The engagement is preferably a slot with which for example a coin can engage, such that the coin forms the tool. Any other engagement or contact for a tool is of course also covered by the invention. In order to show whether the connecting element is situated in the first position or in the second position, the sole of the shoe and/or the cleat tip preferably comprises markers which clearly identify at least the pressing-in position. In order to always press the connecting element into the cleat base in the correct position, the upper side of the cleat base which points towards the cleat tip can comprise positioning elements which co-operate with positioning counter elements formed on the lower side of the cleat tip which points towards the cleat base. When the positioning elements and positioning counter elements engage, the connecting element is for example situated in the pressing-in position when the aforementioned markers are in the corresponding position with respect to each other. The markers can also serve to indicate the unlatched position of the cleat tip, i.e. the position which the cleat tip has to be rotated into in order to be able to remove the cleat tip from the cleat base.

The spring is preferably inserted into the cleat base before the cleat base is connected to the sole of the shoe. To this end, the cleat base can consist of a number of parts, for example two half-shells, which form the cleat base when horizontally joined to each other. Each of the half-shells can comprise a semi-circular cavity each, which together form the opening into which the connecting element can be pressed. A horizontal slot, in which the spring is accommodated, can be formed in each of the half-shells. Preferably, the half-shells can be joined together in a positive fit, before they are inserted into the die for the sole of the shoe and injection-coated. To this end, each of the half-shells can comprise at least two sections exhibiting different outer diameters, and a ring which is slid over one of the sections in order to hold the two half-shells together. In order to adjust the half-shells relative to each other and in order to avoid the half-shells shifting relative to each other when the ring is slid on, the mutually abutting surfaces of the half-shells can for example comprise plug and socket connectors which fix the two half-shells when they are assembled to a sufficient extent that the ring can be slid on without any problems, wherein the inner diameter of the ring corresponds to the outer diameter of one of the sections, preferably the outer diameter of the section exhibiting the smaller diameter. The outer diameter of the ring preferably corresponds to the section of the half-shell exhibiting the larger diameter.

The cleat base can also be formed in one piece, and the spring can be inserted into the cleat base through a laterally open slot, wherein the spring can be held in its position in the cleat base by a stopper which is inserted into the slot before the cleat base is connected to the sole of the shoe; it can be glued in or otherwise secured against slipping, or can be held in its position by means of a tool and only fixed in its position by being connected to the sole of the shoe. If the cleat base is formed in one piece, the slot can be arranged obliquely in the cleat base, such that the spring does not have to comprise a break. In this case, the spring preferably comprises a spring base which is thicker than the spring tip. The slot is dimensioned such that it can hold the spring base in a positive fit, while the spring tip can be moved in the vertical direction in the same slot, as described above. The spring base can for example be thickened simply by bending it over.

The cleat tip is preferably likewise formed in a number of parts, wherein the cleat tip can comprise a first cleat tip part which forms the running surface of the cleat. This running surface is adapted to the respective intended use of the cleat and/or sports shoe. Thus, the cleat for a football boot is designed such that it optimally supports the player's movements such as sudden changes in direction, stopping abruptly or sudden changes in speed, wherein different cleat shapes can be provided for natural grass, artificial turf, dry surfaces and wet surfaces due to rain. The cleat for a golf shoe can be designed such that it provides the player with a firm stance when swinging on moist or wet grass but at the same time does not cause any damage when stepping onto the greens. The first cleat tip part can be formed to be circular, square, oval or in any shape in order to be able to optimally adapt the cleat to the respective intended use and/or in order for example to achieve brand-specific designer effects.

A second cleat tip part can comprise the connecting element; preferably, the second cleat tip part and the connecting element are formed in one piece. The second cleat tip part is preferably rotationally mounted in the first cleat tip part; it can for example be connected to the first cleat tip part in a positive fit. This can be realized by a snap connection in which a circumferential bulge formed on the second cleat tip part snaps into a groove formed on the first cleat tip part, wherein either the bulge or the groove is preferably formed to be circumferential; particularly preferably, the bulge and the groove are formed to be circumferential. Any other connection which allows the second cleat tip part to be rotatable relative to the first cleat tip part is however likewise covered by the scope of the invention.

In order to avoid the first cleat tip part rotating along with the second cleat tip part, the side of the first cleat tip part which faces the cleat base preferably comprises positioning elements which engage with positioning counter elements, formed on the side of the cleat base which faces the cleat tip, when the connecting element is pressed in, wherein the positioning elements and positioning counter elements are preferably shaped such that in its delivered state, the connecting element is always situated in the pressing-in position when the positioning elements are engaged. From this position, the second cleat tip part and therefore the connecting element can be rotated into the unlatching position. Before the removed cleat tip is again inserted into the cleat base, the connecting element can then be rotated into its original position again, in order to have the correct position for pressing in. Alternatively, the cleat tip can also be inserted into the cleat base in the unlatching position, but then has to be rotated in the cleat base with the aid of the tool in order to reach the position in which it is held, clamped, in the cleat base.

In order to enable the user to press the cleat tip into the cleat base in approximately the correct position straight away, without lengthy trial and error, the cleat tip preferably comprises marks which at least indicate when the second cleat tip part is situated in the pressing-in position in the first cleat tip part. The sole of the shoe can also comprise marks, such that the user can identify the position in which they have to press the cleat tip into the cleat base in order for the positioning elements and positioning counter elements to be situated at least approximately in the engaging position with respect to each other when the cleat tip is pressed in.

The invention also relates to a method for connecting a cleat tip to a cleat base which is preferably fastened in the sole of a shoe, wherein the cleat tip having a non-circular connecting element is pressed into a substantially circular opening formed in the cleat base, and the cleat tip or a part of the cleat tip is held in a force fit, for example clamped, in the cleat base. A spring which likewise comprises an opening is preferably introduced into the cleat base, wherein the connecting element is also pressed through this opening when it is pressed into the cleat base, and the cleat base and the cleat tip are preferably embodied as previously described.

BRIEF DESCRIPTION OF THE DRAWINGS

In the following, the invention is explained in more detail on the basis of an example—in this case, a cleat for a golf shoe. All the features shown in the figures and described form part of the scope of the invention. The invention is not however limited to the features shown and described.

Specifically, the figures show.

DETAILED DESCRIPTION

Figure 1:
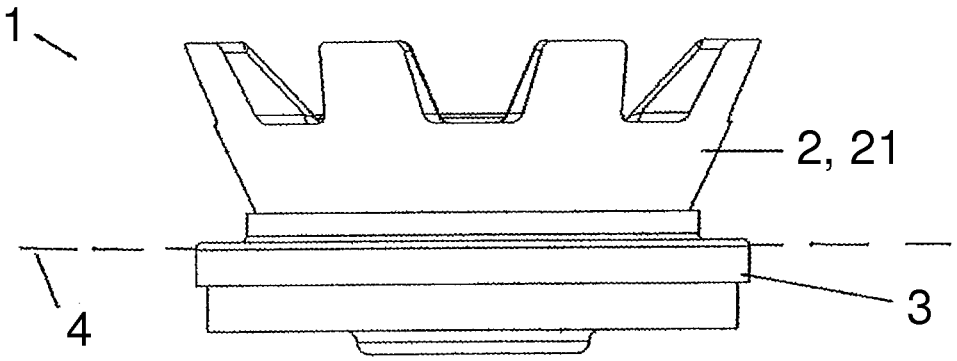
FIG. 1 is a side elevation view of a cleat in accordance with an embodiment of the invention.

FIG. 1 shows a side view of an embodiment of the cleat 1 in accordance with the invention for a golf shoe. The cleat tip 2—or respectively, in the view shown, only the first cleat tip part 21 which is designed in the shape of a crown—is shown. The cleat tip 2 is positioned on the cleat base 3, wherein the cleat base 3 comprises sections 31, 32, 33, 34, 35 which exhibit different outer diameters and is fastened in the sole (not shown) of a golf shoe up to the dashed line 4. It is preferably injected into the sole of the shoe, wherein the finished cleat base 3 is inserted into the die for the sole of the shoe and preferably injected in an in-tooling method. It is also conceivable to latterly insert the cleat base 3 into prepared openings in the sole of the shoe and connect it to the sole by means of a glue or other methods. Preferably, the connection should be a material-fit connection, such that it is not possible to remove the cleat base 3 from the sole of the shoe without destroying it.

Figure 2:
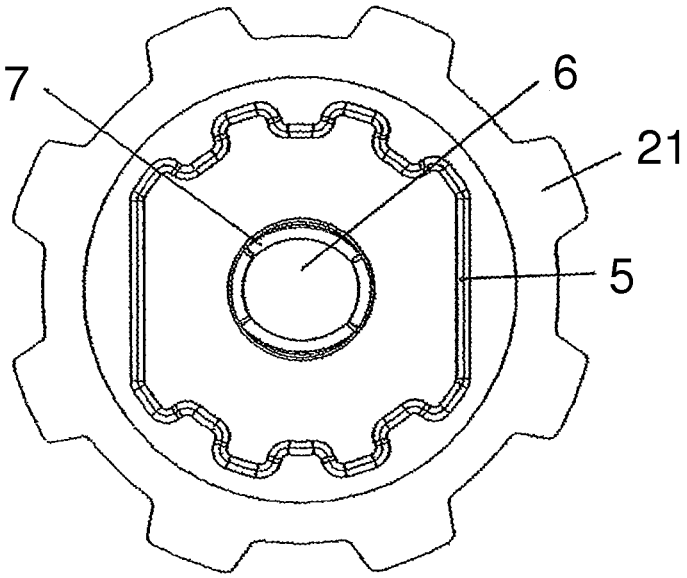
FIG. 2 is a bottom plan view of the first cleat tip part of the cleat of FIG. 1.

FIG. 2 shows a part of the cleat tip 2, as viewed from the cleat base 3, namely the first cleat tip part 21 which has an outer circumference which forms the running surface of the cleat. The lower side of the first cleat tip part 21 comprises a circumferential positioning element 5 which together with a positioning counter element (not shown) on the upper side of the cleat base 3 fixes the position of the cleat base 3 with respect to the cleat tip 2. As shown by the embodiment of the positioning element 5, the cleat tip 2 can only be placed onto the cleat base 3 in two positions, rotated by 180°, such that the positioning elements 5 and the positioning counter elements (not shown) engage with each other. An opening 6 is formed in the centre of the first cleat tip part and circumferentially comprises a coupling part 7. The second cleat tip part 22 (not shown) having the connecting element 8 can be inserted through this opening 6, wherein the end of the second cleat tip part 22 which faces away from the cleat base 3 comprises a coupling counter part which co-operates with the coupling part 7 such that the second cleat tip part 22 can be rotated relative to the first cleat tip part 21. The coupling part 7 can for example be a groove which a bulge, formed on the second cleat tip part 22, can snap into.

Figure 3:
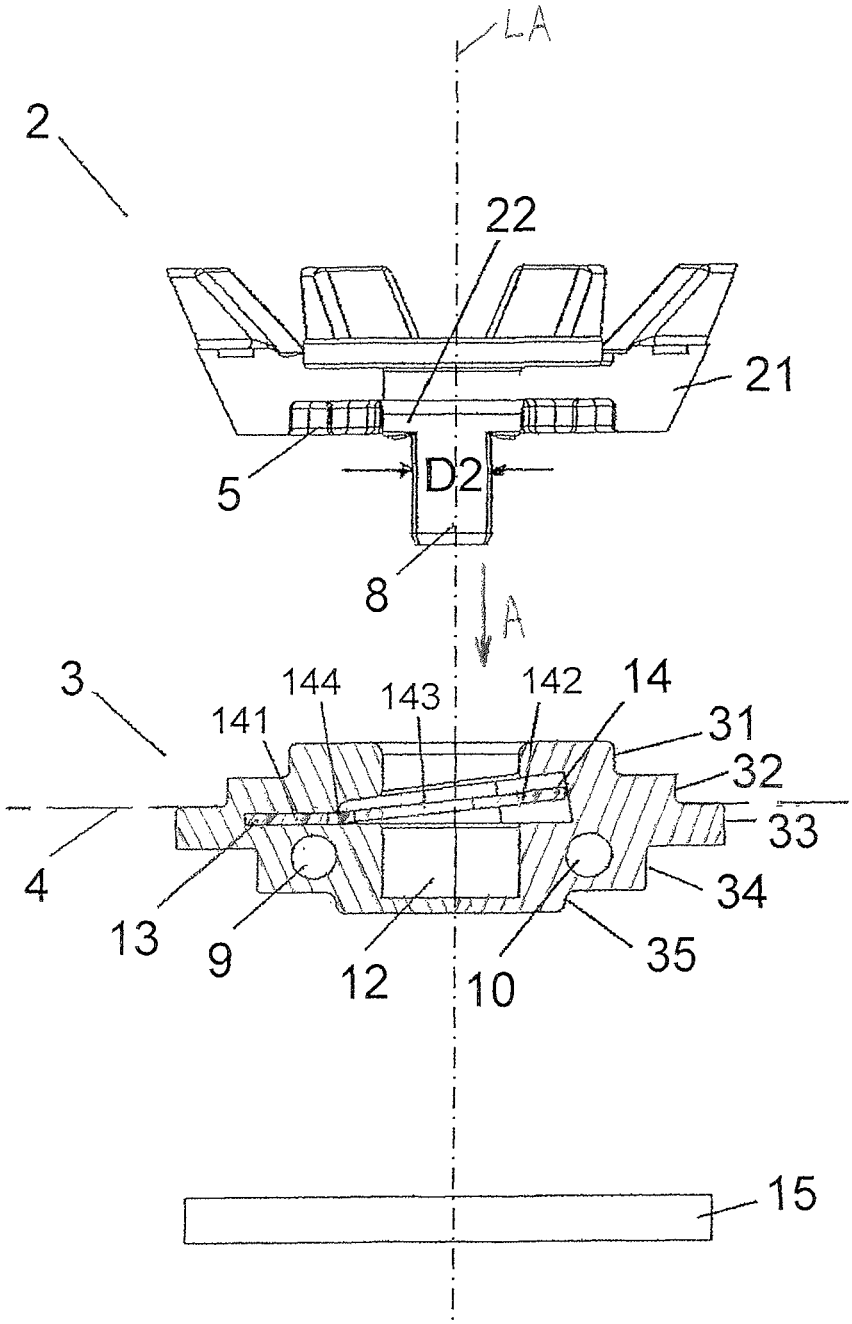
FIG. 3 is an exploded view of the parts of the cleat of FIG. 1 with the cleat base in section and with the connecting element in a first rotational angular position defining the pressing-in position.

FIG. 3 shows the cleat 1, in section, before the cleat tip 2 is pressed into the cleat base 3. The cleat tip 2 comprises the first cleat tip part 21 and the second cleat tip part 22 which is rotationally mounted in the first cleat tip part 21 and comprises the connecting element 8. The connecting element 8 has the shape of a non-circular pin exhibiting a first diameter D1 which runs perpendicular to the sectional plane in FIG. 3 and a second diameter D2 which is smaller than the first diameter D1. The positioning element 5 is shown on the lower side of the cleat tip 2 or first cleat tip part 21, respectively.

The cleat base 3 comprises sections 31, 32, 33, 34, 35 which exhibit different outer diameters, wherein the section 31 is formed by the positioning counter element or elements, and the upper edge of the section 33 is approximately planar with the sole of the shoe (not shown) when the cleat base 3 is installed in the sole.

In the embodiment shown, the cleat base 3 consists of two half-shells 3*a*, 3*b* which are formed to be mirror-inverted, one of which is shown. The circles 9 and 10 represent plug connection elements 9, 10 with which the two half-shells 3*a*, 3*b* can be connected to each other. The cleat base comprises a central opening in the form of a transit hole or blind hole 12 which the connecting element 8 is pressed into when the cleat tip 2 is connected to the cleat base 3. A slot 13 is introduced approximately in the axial centre of the cleat base 3 and in the present case exhibits a wedge shape. A spring 14 is situated in the slot and comprises a spring base 141 in a first part 13*a* of the slot 13 and a spring tip 142 in a second part 13*b* of the slot 13 and which comprises an opening 143 which has substantially the same diameter as the hole 12 with a first extent 143*a* and a second extent 143*b*. The spring base 141 is connected to the spring tip 142 in a break 144, wherein the break 144 runs parallel to the diameter D1, i.e. perpendicular to the sectional plane, the spring base 141 runs approximately parallel to the sole of the shoe (not shown), and the spring tip 142 points towards the cleat tip 2 at an angle of about 20°. The slot 13 is designed such that the spring 14 cannot be moved in the horizontal direction, i.e. parallel to the sole of the shoe, but the spring tip 142 does have freedom of movement in the direction perpendicular to the sole of the shoe.

Lastly, FIG. 3 shows a ring 15. When the cleat base 3 is assembled, said ring 15 is slid over the section 34 and thus holds the two half-shells of the cleat base 3 together in a positive fit.

Figure 4:
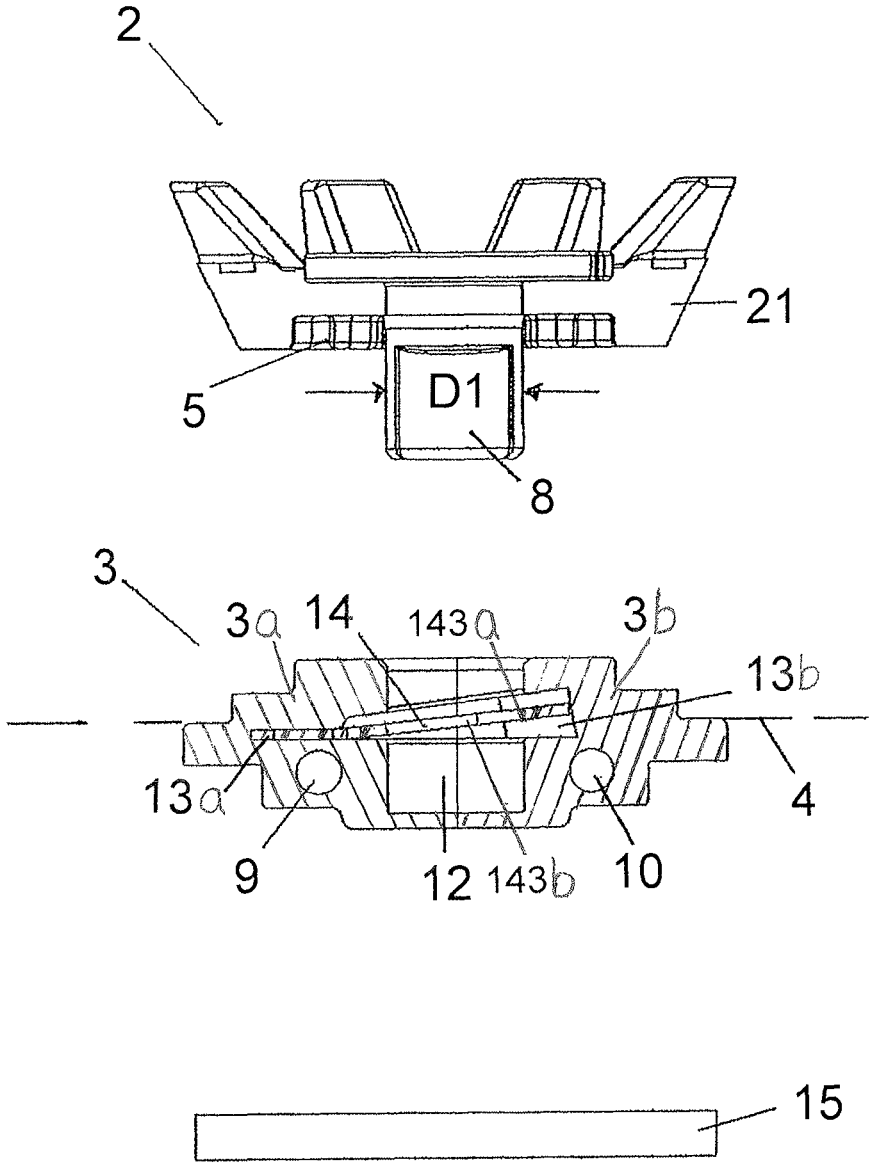
FIG. 4 is an exploded view of the parts of the cleat of FIG. 1 with the cleat base in section and with the connecting element in a second rotational angular position defining the clamping position.

FIG. 4 shows the same parts as FIG. 3, except that the connecting element 8 has been rotated by 90° about the longitudinal axis LA, such that the diameter D1 then runs parallel to the sectional plane. The break therefore then runs parallel to the diameter D2 of the connecting element 8, and the diameter D1—which substantially corresponds to the inner diameter of the hole 12 and the diameter of the spring opening 143—is then clamped in the projection defined at the first extent 143*a* of the diameter of the spring opening 143, wherein said projection is reduced in size by the application of the spring 14. In this clamping position, the cleat tip 2 can be moved even further into the hole 12, in the pressing-in direction A, if pressure forces arise in the direction of the cleat base 3; by contrast, if forces act on the cleat tip 2 in the opposite direction, then the spring 14 is pressed more firmly against the connecting element 8, i.e. the elastic restoring force of the spring 14 increases. In this position, it is no longer possible to remove the cleat tip 2 from the cleat base 3.

Figure 5A:
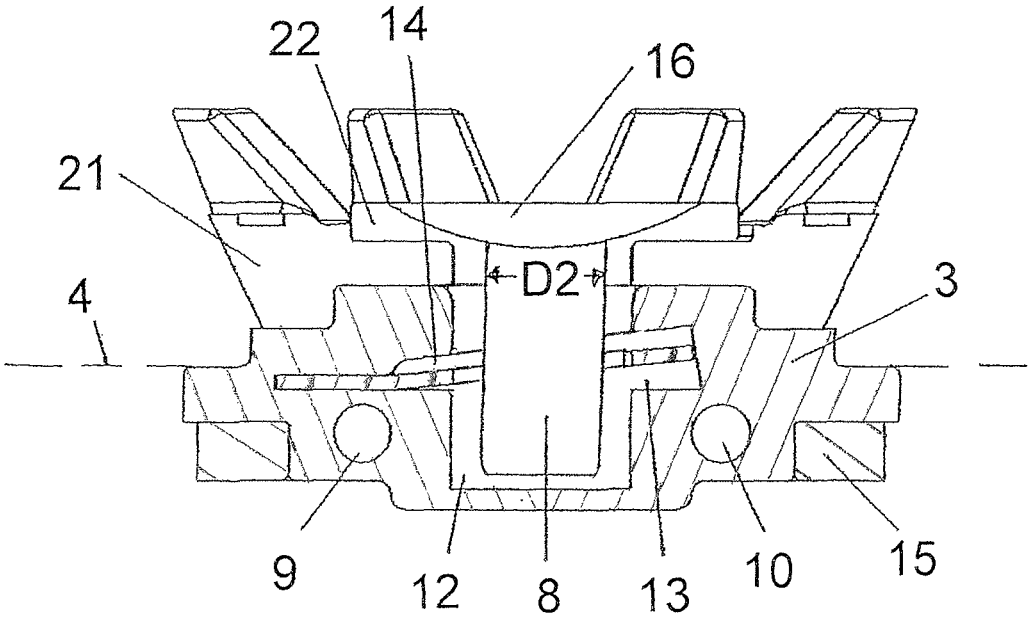
FIGS. 5A and 5B are cross-sectional, except for the cleat tip, views of the cleat of FIG. 1 in an assembled condition, in the pressing-in position and in the clamping position, respectively.

FIG. 5A shows the cleat 1 with the cleat tip 2 in the unlatching position in which it is pressed into the cleat base 3 but not held clamped. In this position, the cleat tip 2 can be removed from the cleat base 3 without any major application of force. A slot 16 for engaging a tool (not shown), which runs parallel to the sectional plane, is indicated in the part of the second cleat tip part 22 which is rotationally mounted in the opening 6 of the first cleat tip part 21. The diameter D1 of the connecting element 8 is perpendicular to the sectional plane. The ring 15 is shown in the position in which it holds the two half-shells of the cleat base 3 together in the positive fit.

Figure 5B:
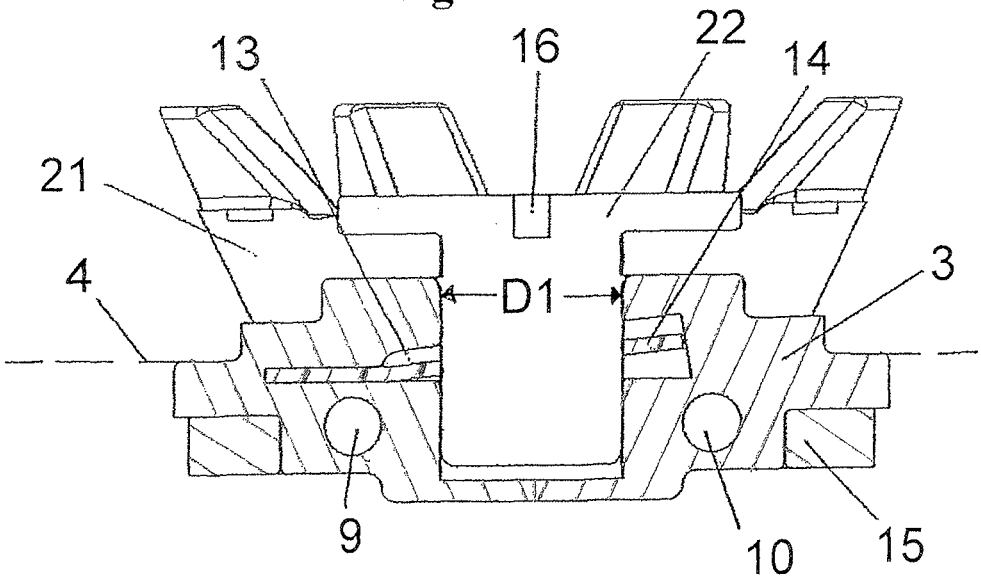

In FIG. 5B, the second cleat tip part 22 is situated in the pressing-in position in which the diameter D1 of the connecting element 8 runs parallel to the sectional plane and therefore transverse to the break line 144 of the spring 14. The cleat tip 2 is then firmly anchored in the cleat base 3, solely by a force fit. The second cleat tip part 22 can be rotated out of this position by 90° using the tool, whereby the slot 16 is then perpendicular to the sectional plane in the position shown in the first illustration, in which the cleat tip 2 can be removed from the cleat base 3.

LIST OF REFERENCE SIGNS

1 cleat
2 cleat tip
21 first cleat tip part
22 second cleat tip part
3 cleat base
  3*a* cleat base first half
  3*b* cleat base second half
31 section
32 section
33 section
34 section
35 section
4 plane of the sole of the shoe
5 positioning element
6 opening
7 coupling part
8 connecting element
9 plug connection element
10 plug connection element
12 hole
13 slot
  13*a* first part of slot
  13*b* second part of slot
14 spring
141 spring base
142 spring tip
143 spring opening
  143*a* first extent of spring opening
  143*b* second extent of spring opening
144 break in the spring, break
15 ring
16 tool slot, slot
D1 first diameter
D2 second diameter
LA longitudinal axis

The invention claimed is:

1. A cleat for a sports shoe, comprising;
a cleat base defining a base opening;
a spring positioned within the cleat base, the spring including a spring base and a spring tip with a break line defined there between whereat the spring tip bends relative to the spring base, the spring tip defining a spring opening aligned with the base opening; and
a cleat tip having a connecting element, the connecting element having the shape of a non-circular pin, the pin defining a spring contacting area having a first diameter and a second diameter, measured perpendicular to the first diameter, wherein the second diameter is smaller than the first diameter and the pin has a constant cross-section within the spring contacting area,
wherein, in order to connect the cleat tip to the cleat base, the pin is pressed into the base opening and through the spring opening such that the spring contacting area of the pin is axially aligned within the spring opening and the connecting element is positioned in a first angular position such that the break line of the spring lies transverse to the first diameter whereby a portion of an inner perimeter of the spring opening presses laterally against the connecting element and thus holds it in a clamping force, and the connecting element is rotatable in the cleat base relative to the spring to a second rotational angular position where the break line of the spring lies transvers to the second diameter whereby the portion of the inner perimeter of the spring is disengaged from the connecting element such that the cleat tip is removable, counter to the pressing-in direction, from the cleat base.

2. The cleat according to claim 1, wherein the spring opening has substantially the same diameter as the base opening.

3. The cleat according to claim 2, wherein the spring is a leaf spring.

4. The cleat according to claim 2, wherein the spring tip protrudes form the spring base at an angle along the break line with the angle more than 0° and less than 90° with respect to a longitudinal axis of the connecting element.

5. The cleat according to claim 4, wherein when the connecting element is pressed in, the second diameter points substantially perpendicular to the break line of the spring.

6. The cleat according to claim 2, wherein the spring is arranged in the cleat base at an angle of more than 0° and less than 90° with respect to a longitudinal axis of the connecting element.

7. The cleat according to claim 1, wherein the cleat base is designed in a number of parts.

8. The cleat according to claim 7, wherein the cleat base comprises a first half-shell and a second half-shell.

9. The cleat according to claim 8, wherein each of the half-shells comprises at least two sections exhibiting different diameters.

10. The cleat according to claim 9, wherein the two half-shells are held together in a positive fit by a ring, wherein an inner diameter of the ring corresponds to one of the outer diameters of the sections.

11. The cleat according to claim 8, wherein the first half-shell comprises a slot for accommodating the spring base and the second half-shell comprises a slot for accommodating the spring tip, the slots having different shapes.

12. The cleat according to claim 1, wherein the cleat tip comprises at least a first cleat tip part and a second cleat tip part which are connected to each other in a positive fit, wherein the second cleat tip part comprises the connecting element and is rotationally mounted in the first cleat tip part.

13. The cleat according to claim 12, wherein the first eat tip part defines the outer circumference of the cleat and forms the running surface of the cleat.

14. The cleat according to claim 1, wherein an elastic restoring force of the spring generates the force fit between the cleat base and the connecting element which protrudes through the spring opening, and the clamping force of the spring increases when a load is applied to the connecting element in a direction opposite to the pressing-in direction of the connecting element.

* * * * *